US010079006B2

(12) United States Patent
Brain

(10) Patent No.: US 10,079,006 B2
(45) Date of Patent: Sep. 18, 2018

(54) DETACHABLE BRIDGE FOR STRINGED INSTRUMENT

(71) Applicant: Archibald Ian Jeremy Brain, Mahe (SC)

(72) Inventor: Archibald Ian Jeremy Brain, Mahe (SC)

( * ) Notice: Subject to any disclaimer, the term of this patent is extended or adjusted under 35 U.S.C. 154(b) by 0 days.

(21) Appl. No.: 15/522,872

(22) PCT Filed: Oct. 30, 2015

(86) PCT No.: PCT/GB2015/053286

§ 371 (c)(1),
(2) Date: Apr. 28, 2017

(87) PCT Pub. No.: WO2016/067053

PCT Pub. Date: May 6, 2016

(65) Prior Publication Data

US 2017/0337906 A1 Nov. 23, 2017

(30) Foreign Application Priority Data

Oct. 31, 2014 (GB) ..... 1419480.7

(51) Int. Cl.
*G10D 3/04* (2006.01)
*G10D 3/12* (2006.01)

(52) U.S. Cl.
CPC ..... *G10D 3/04* (2013.01); *G10D 3/12* (2013.01)

(58) Field of Classification Search
CPC ..... G10D 3/04; G10D 3/12
See application file for complete search history.

(56) References Cited

U.S. PATENT DOCUMENTS

| | | | | |
|---|---|---|---|---|
| 2,803,982 A * | 8/1957 | Gassin | A45C 11/24 84/275 |
| 4,073,211 A * | 2/1978 | Jorgensen | G10D 1/08 84/267 |
| 4,377,962 A | 3/1983 | Parker | |
| 4,464,970 A | 8/1984 | Mischakoff | |
| 4,573,391 A * | 3/1986 | White | G10D 1/08 84/291 |
| 6,025,548 A * | 2/2000 | Ehrlich | G10D 1/08 84/267 |
| 6,956,157 B2 * | 10/2005 | Strobel | G10D 1/08 84/298 |
| 7,459,618 B2 * | 12/2008 | Kim | G10D 3/04 84/298 |

(Continued)

FOREIGN PATENT DOCUMENTS

WO WO 2016/067053 5/2016

OTHER PUBLICATIONS

GB Patent Application No. 1419480.7, filed Oct. 31, 2014.

*Primary Examiner* — Robert W Horn
(74) *Attorney, Agent, or Firm* — Craig R. Miles; CR Miles P.C.

(57) ABSTRACT

The invention relates to a detachable bridge for a stringed instrument and the stringed instrument including such a detachable bridge. More specifically, the invention may comprise a detachable portion and a non-detachable portion. The strings are secured to the detachable portion. In a preferred embodiment, the detachable portion is secured by a retaining means of the non-detachable portion.

20 Claims, 8 Drawing Sheets

(56) References Cited

U.S. PATENT DOCUMENTS

| | | | | |
|---|---|---|---|---|
| 7,663,038 | B2 * | 2/2010 | Stadler | G10D 3/04 84/307 |
| 7,696,419 | B2 * | 4/2010 | Chadwick, V | G10D 1/08 84/173 |
| 7,705,224 | B1 * | 4/2010 | Ward | G10D 1/08 84/267 |
| 8,163,987 | B1 | 4/2012 | Dennis | |
| 9,514,719 | B1 * | 12/2016 | Ward | G10D 1/08 |
| 2003/0164080 | A1 | 9/2003 | Childress | |
| 2003/0177883 | A1 | 9/2003 | Rose et al. | |
| 2004/0159204 | A1 | 8/2004 | Rose | |
| 2014/0311317 | A1 | 10/2014 | Gray et al. | |
| 2017/0337906 | A1 * | 11/2017 | Brain | G10D 3/12 |

* cited by examiner

DETACHABLE BRIDGE FOR STRINGED INSTRUMENT

This application is the United States National Stage of International Patent Cooperation Treaty Patent Application No. PCT/GB2015/053286, filed Oct. 30, 2015, which claims the benefit of GB Patent Application No. 1419480.7, filed Oct. 31, 2014, each hereby incorporated by reference herein.

The present application relates to an apparatus for reversibly detaching the strings of a stringed instrument as a single piece. More particularly, the application relates to a detachable bridge for a stringed instrument and the stringed instrument including such a detachable bridge.

Many stringed instruments have a bridge. The bridge secures the strings to the body of the instrument and positions the strings at the correct height to allow them to resonate when struck.

In order to inspect or repair the body or neck of a stringed instrument, the strings must be individually removed. This is a time consuming process and is made further undesirable as the instrument will subsequently need to be restrung and retuned. Restringing an instrument can be a lengthy process and may involve the additional cost of new strings.

In addition, when disassembling a collapsible instrument, such as a collapsible guitar, the strings must also be removed or, alternatively, remain attached and stored within the body of the guitar which can lead to them becoming entangled. As above, removing and restringing an instrument can be time consuming and, in the case of the strings becoming entangled, may lead to damage to the strings.

The present invention seeks to mitigate disadvantages such as those described above.

In a first embodiment of apparatus according to the invention, there is provided an apparatus for reversibly detaching the strings of a stringed instrument as a single piece from a bridge of the instrument. Detaching the strings as a single piece enables the body and neck of an instrument, which would otherwise be obstructed by the strings, to be easily accessible. In the context of the present invention, the term reversibly refers to being able to couple and uncouple the detachable portion from the non-detachable portion as many times as is required by a user.

Preferably, the apparatus comprises a detachable portion and a non-detachable portion. More preferably, the non-detachable portion is adapted to secure the detachable portion to the stringed instrument. Advantageously, the bridge is separated into two portions and the portion that is non-detachable can be used to quickly and efficiently secure the detachable portion. This allows the user to detach and replace the strings to the body of the instrument with a minimum of effort. The detachable and non-detachable portions form the bridge of the stringed instrument. Having a detachable bridge allows the strings to be detached from a stringed instrument without them becoming disordered and entangled. On many stringed instruments, the strings are secured to the instrument by passing them through an aperture in the bridge at one end of the instrument. For example, guitars have a bridge that secures the strings to the body of the guitar at one end and to the head of the guitar at the other end. Having a detachable bridge is advantageous as it allows the strings to be detached from the body of a guitar quickly and without undue effort. Strings may be detached in order to inspect or replace features of the body or a guitar or neck of a guitar, for example, the frets of a guitar can become worn and in need of replacement. Alternatively, a detachable bridge may be useful as part of the disassembly of a collapsible guitar. In one embodiment, the detachable portion of the bridge may be used in conjunction with a detachable headstock of the stringed instrument, which may be a collapsible guitar, to remove the strings as a single piece. The headstock of a stringed instrument is the portion which is at the opposite end of the instrument to the bridge and often includes the means for tuning the instrument. Therefore, the combination of a detachable bridge and a detachable headstock may form a means for removing the strings from a stringed instrument. In an alternative embodiment, the stringed instrument may only have a detachable bridge.

Preferably, the detachable portion further comprises means for reversibly coupling to the strings of the stringed instrument. More preferably, the means for reversibly coupling to the strings comprises at least one aperture for each of the stings in the detachable portion. This allows the strings to be secured to the detachable portion and to be detached from the body of the instrument as one piece.

Preferably, the non-detachable portion comprises a string retaining channel for each of the strings which correspond to the position of the strings coupled to the detachable portion such that when the detachable portion is secured by the non-detachable portion the strings coupled to the detachable portion each sits within a corresponding string retaining channel. The string retaining channels of the non-detachable portion allow the strings coupled to the detachable portion to be held securely in the correct position and allow the strings to be repeatedly struck to create sound without altering the position of the strings along the bridge.

Preferably, the non-detachable portion comprises a retaining means to prevent inadvertent detachment, the retaining means adapted to retain the detachable part against the tension of the strings. This advantageously allows the detachable portion to be held securely to the body of the guitar without the need for any additional components. The retaining means allows the detachable portion to couple to the non-detachable portion and affix the detachable portion firmly without further input or effort from a user. The tension generated by the string forces the detachable portion into contact with the non-detachable portion.

Preferably, the retaining means comprises means to prevent movement of the detachable part in a direction substantially perpendicular to the direction of the body. The retaining means prevents the force generated by the taught stringed on the stringed instrument from pulling the string away from the body of the stringed instrument. Without the retaining means the strings would be forced away from the body of the stringed instrument and the detachable portioned forced perpendicular to the body of the stringed instrument.

Preferably, the retaining means comprises a lip, wherein the lip protrudes in a plane substantially parallel to the body of the stringed instrument in a direction away from the neck of the stringed instrument. The lip protrudes from the non-detachable portion on the end of the detachable portion facing in a direction away from the neck of the stringed instrument. The projection from the non-detachable portion that forms the lip holds the detachable portion in place and provides a stop that secures the detachable portion due to the force of the strings pulling the detachable portion towards the neck and also perpendicular to the body of the stringed instrument.

Preferably, the lip comprises the string retaining channels through which each string can pass. The string retaining channels allow the strings of the stringed instrument to be guided into position so that they can be secured to the detachable portion and not move when the instrument is played. Movement of the strings when it the instrument is played would make the strings "buzz" against the body of the instrument and lead to the instrument going out of tune easily.

Preferably, the detachable portion is secured to the non-detachable portion the detachable portion is positioned above the surface of the body of the stringed instrument. Having the detachable portion secured above the body of the stringed instrument prevents to vibrating against the body of the instrument creating an unwanted buzzing sound.

Preferably, the detachable portion has a tongue. More preferably, the non-detachable portion comprises a groove, wherein the tongue of the detachable portion reversibly couples to the groove in the non-detachable portion such that the tongue of the detachable portion is secured by the groove of the non-detachable portion. A tongue and groove arrangement is advantageous as it provides a stable reversibly releasable system that does not require additional materials to be used in securing the detachable portion to the non-detachable portion. For example, if metal pins are inserted into the detachable portion in order to secure it to apertures in the non-detachable portion, then these pins may weaken the wood and lead to the detachable portion splitting due to the pressure. In an alternative embodiment, this arrangement can be reversed with the detachable portion comprising the groove and the non-detachable portion comprising a tongue.

Preferably, the detachable portion is secured to the non-detachable portion about 1.5 mm above the surface of the soundbox. It is advantageous that there is no direct contact between the detachable portion and the body of the stringed instrument, so as to avoid any disadvantageous "buzzing" should the two come into contact when the instrument is played.

Preferably, the detachable portion comprises four side walls and an upper and lower surface, wherein one of the side walls is a distal end that faces towards the neck of the stringed instrument and another side wall is a proximal end that faces away from the neck of the stringed instrument, wherein the proximal and distal side walls extend substantially perpendicular to the plane of an upper surface of the soundbox, and wherein the upper surface and lower surface are parallel to the plane of the surface of the soundbox.

Preferably, the detachable bridge has two or more apertures for securing the strings to the detachable portion. More preferably, a first aperture of the at least two apertures in the detachable portion forms a conduit between the proximal end and the distal end and, even more preferably, a second aperture of the at least two apertures in the detachable portion forms a conduit between the upper surface and the proximal end. This arrangement may be preferred if the first aperture and the second aperture are positioned off set from one another such that a string of the stringed instrument may be secured by passing the string through the first aperture and then the second aperture. The arrangement described in this embodiment is advantageous as it provides a means to secure the strings of the stringed instrument to the detachable portion. The string may be passed through the first aperture and then pulled upwards around the proximal end and the upper surface such that it can be threaded through the second aperture which exits again at the proximal end. The end of the string can then be passed through the loop formed by passing the string from the exit of the first aperture to the entrance of the second aperture. When the string is passed through the loop the string can be tightened to tune the guitar and trap it against the proximal end of the detachable portion.

Preferably, the detachable bridge comprises a first aperture and a second aperture for each of the strings of the stringed instrument. This is advantageous as each string can be foxed to the detachable portion of the guitar using the above-mentioned technique.

In a second embodiment of apparatus according to the invention, there is provided a non-percussive stringed instrument comprising an apparatus according to the first embodiment of the invention.

More preferably, the non-percussive stringed instrument is a guitar. More preferably, the guitar is a collapsible guitar.

The invention will now be described with reference to the accompanying figures.

Figure 1:
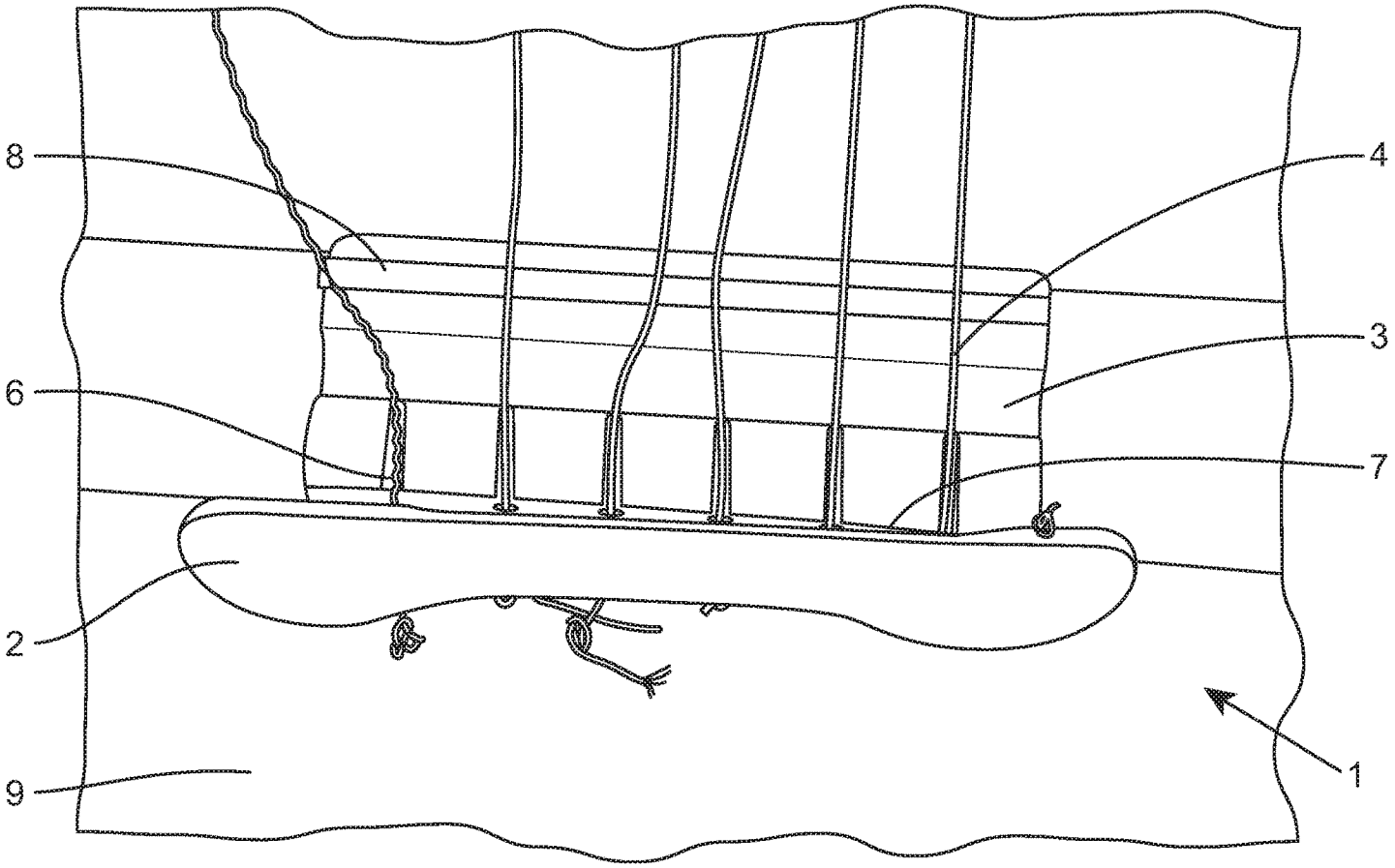
FIG. 1 is a view from above of a first embodiment of the detachable bridge for a stringed instrument.

Referring to FIG. 1, there is illustrated a reversibly detachable apparatus for securing the strings of a stringed instrument 1. In the embodiment of FIG. 1, the apparatus is the bridge of a guitar and the apparatus is depicted as it would appear when secured to the body of the guitar. The guitar may be a classical or Spanish guitar.

FIG. 1 shows the apparatus comprising a detachable portion 2 and a non-detachable portion 3. The strings 4 are secured to the detachable portion 2 and are held securely in the string retaining channel 6 of the non-detachable portion 3. The strings 4 pass through the string retaining channel 6 and over the saddle 8 of the non-detachable portion 3. The saddle 8 ensures the strings 4 are positioned at the correct height along the body of the guitar 9. The detachable portion 2 is shown as secured by the retaining means 7 of the non-detachable portion 3.

Figure 2:
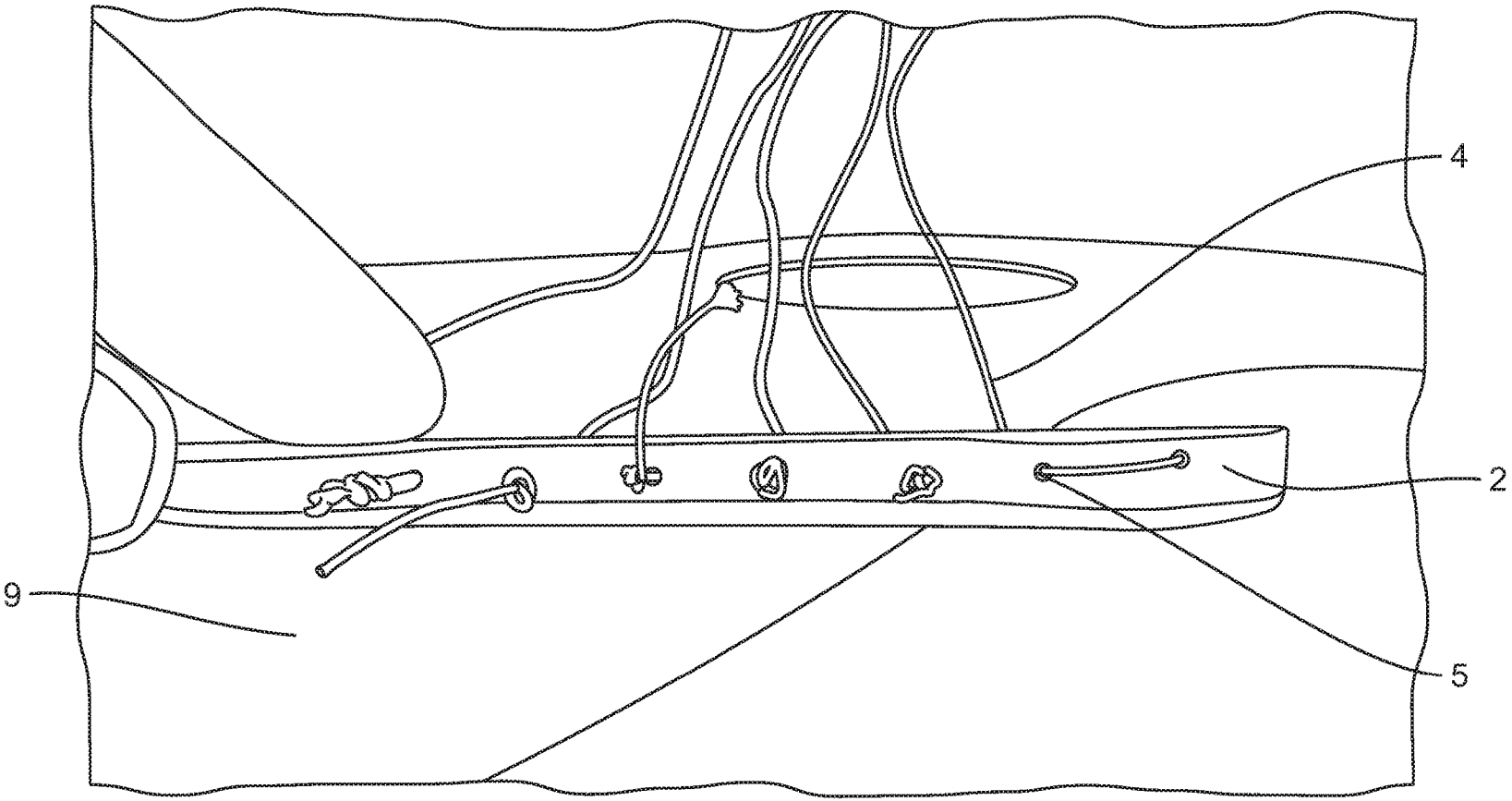
FIG. 2 is a perspective view of the detachable portion of the apparatus.

FIG. 2 shows the detachable portion 2 of the apparatus of FIG. 1 after it has been detached from the body of the guitar 9. The detachable bridge 2 comprises four side walls and an upper and lower surface, wherein one of the side walls is a distal end that faces towards the neck of the guitar and another side wall is a proximal end that faces away from the neck of the guitar, wherein the proximal and distal side walls extend substantially perpendicular to the plane of an upper surface of the soundbox of the guitar, and wherein the upper surface and lower surface are parallel to the plane of the surface of the soundbox of the guitar. The strings 4 are secured in the apertures 5 of the detachable portion 2. The strings 4 can be threaded through the apertures 5 of the detachable portion 2 and tied off to secure them in the apertures 5. Alternatively, the strings 4 may be provided with a stop that abuts the aperture and secures the strings in the apertures 5.

Figure 3:
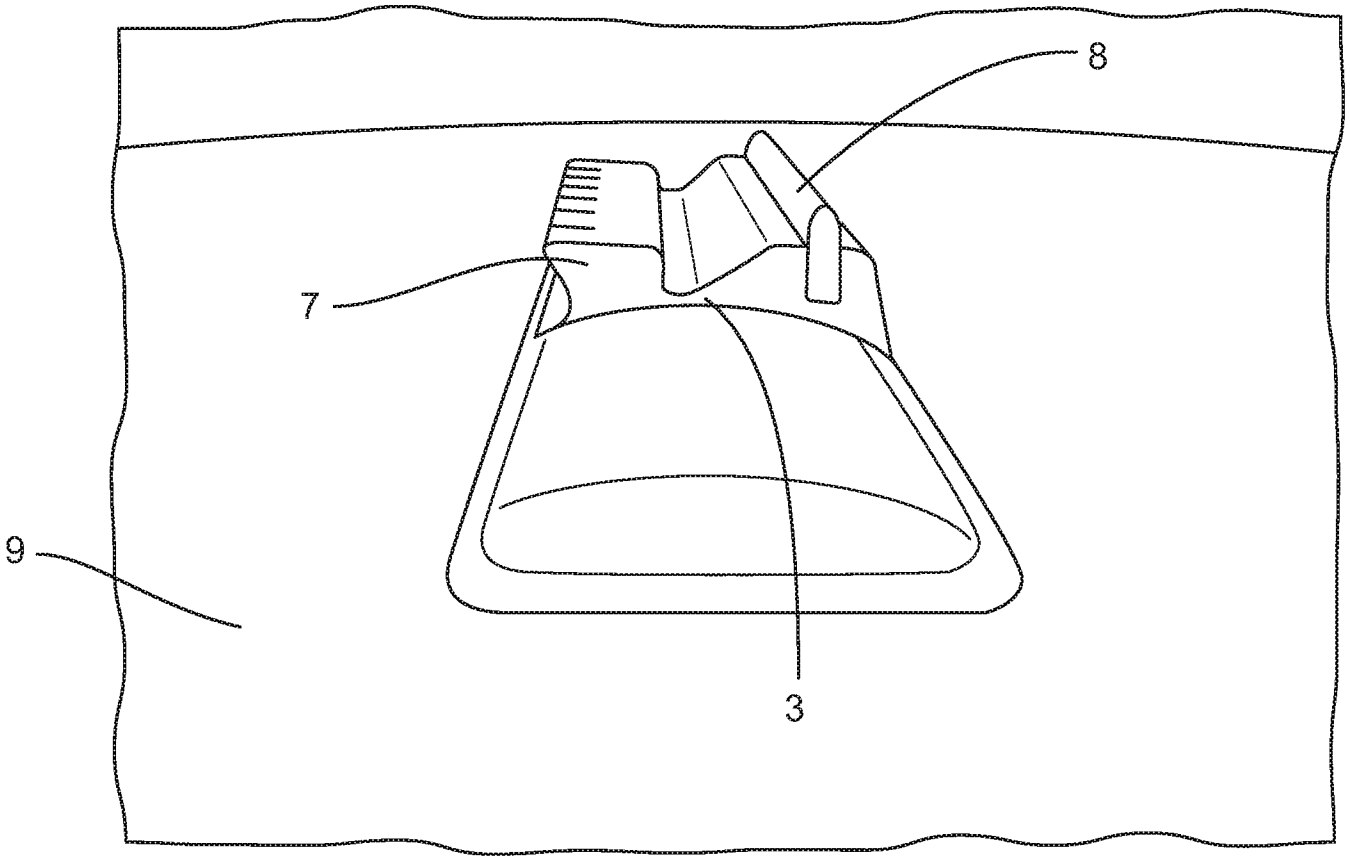
FIG. 3 is a perspective view of the non-detachable portion of the apparatus.

FIG. 3 shows the non-detachable portion 3 of the apparatus of FIG. 1 from a side view. The non-detachable portion 3 is secured to the body of the guitar 9. The retaining means 7 allow the detachable portion 2 to be inserted under the retaining means 7 and be secured. The retaining means 7 being of sufficient length to securely fasten the detachable portion to the body of the guitar 9. The strings 4 can then be placed over the saddle 8.

Figure 4:
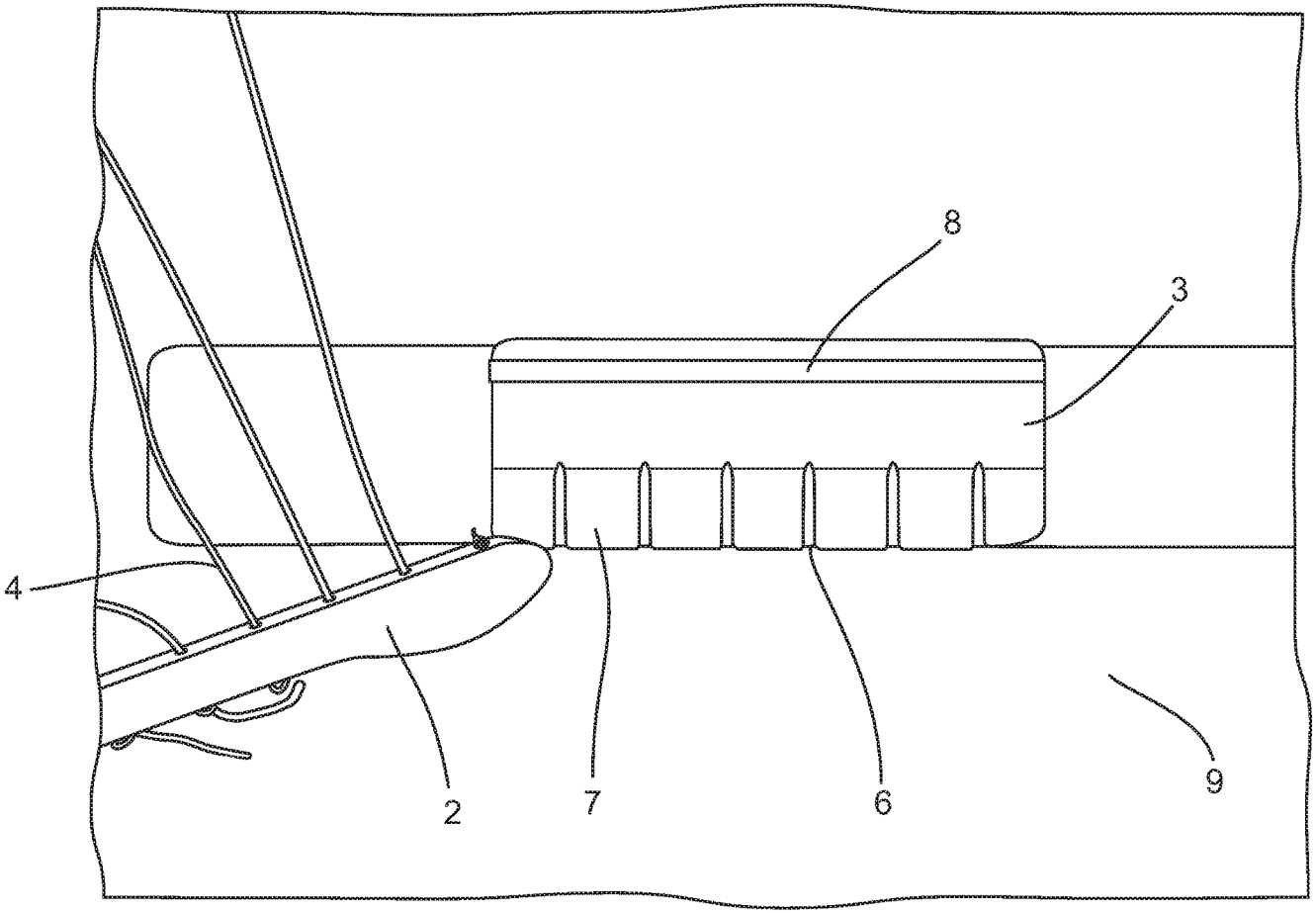
FIG. 4 is a view from above of the detachable portion when detached from the non-detachable portion of the apparatus.

Referring to FIG. 4, there is illustrated the detachable portion 2 and non-detachable portion 3 of FIG. 1 as they would appear when the detachable portion 2 has been detached. The strings 4 remain secured to the detachable portion 2. In one embodiment of the apparatus, in order to detach the two portions, a user may pull the detachable portion 2 away from the body of the guitar 9 such that it slips out from under the retaining means 7. The strings 4 coupled to the detachable portion 2 can then slide out of the string retaining channel 6 and away from the body of the guitar 9 and the saddle 8.

In a further embodiment shown in FIGS. 5 to 8, the strings are secured to the detachable portion using a different arrangement of apertures than is shown in FIGS. 1 to 4. FIGS. 5 to 8 show that the detachable portion may have two apertures for each of the strings. The apertures may be arranged such that the two holes are positioned diagonally from each other with respect to the horizontal axis of the detachable bridge (horizontal with respect to the front plane of the guitar body), such that the free end of the string is trapped against the vertical outer wall of the bridge (vertical with respect to the front plane of the guitar body).

As for the embodiment of FIG. 2, in the embodiments of FIGS. 5 to 8 of the detachable bridge 2 comprises four side walls and an upper and lower surface, wherein one of the side walls is a distal end that faces towards the neck of the guitar and another side wall is a proximal end that faces away from the neck of the guitar, wherein the proximal and distal side walls extend substantially perpendicular to the plane of an upper surface of the soundbox of the guitar, and wherein the upper surface and lower surface are parallel to the plane of the surface of the soundbox of the guitar.

Figure 5:
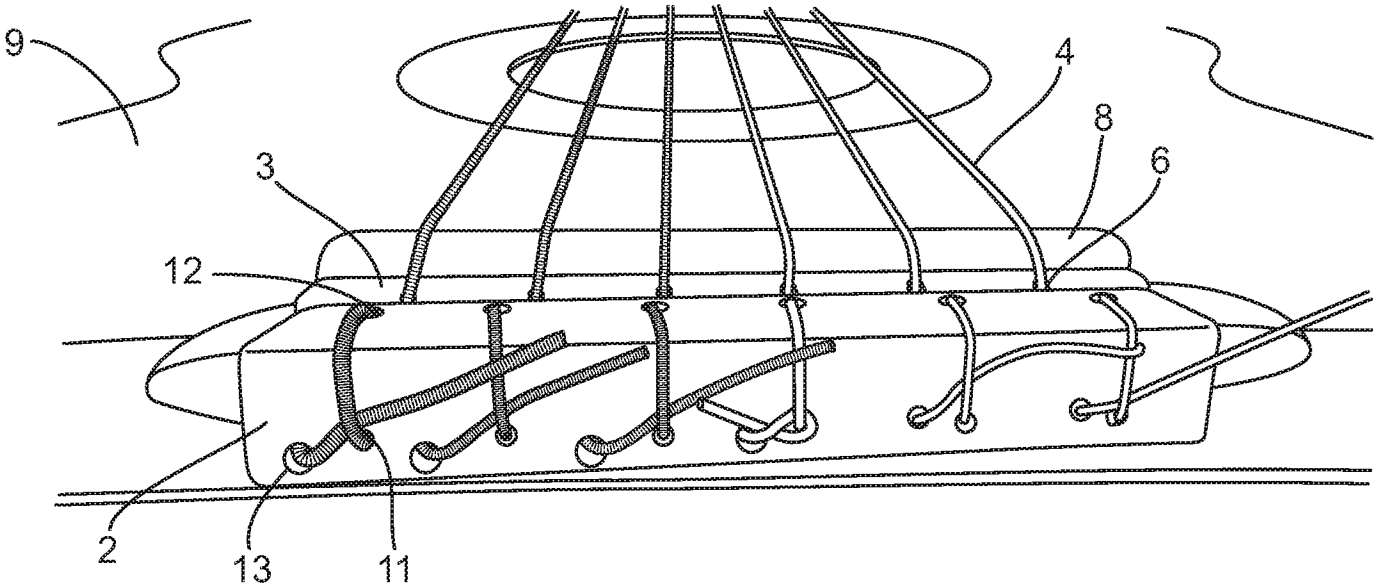
FIG. 5 is a view from above of a further embodiment of the detachable bridge for a stringed instrument showing the detachable portion coupled to the non-detachable portion.

FIG. 5 shows the detachable bridge 2 coupled to the body of a guitar 9. The detachable bridge is coupled to a non-detachable portion 3. The non-detachable portion comprises a saddle 8 and string retaining channel 6. The strings 4 of the guitar slot into the string retaining channel 6 and pass through the entrance of a first aperture 10 (not shown in FIG. 5) in the distal end of the detachable portion 2. The string leaves the aperture through the exit of the first aperture 11 at the proximal end of the detachable portion 2. The string 4 proceeds to pass up the proximal end of the detachable portion 2 and onto the upper surface of the detachable portion 2. The string 4 then passes through the entrance of the second aperture 12 on the upper surface of the detachable portion 2 and then exits through the exit of the second aperture 13 on the proximal end of the detachable portion 2. The string is secured by passing the string through the loop formed by the string 4 between the exit of the first aperture 11 and the entrance to the second aperture 12. The string is therefore secured to the detachable portion by this arrangement of apertures.

Figure 6:
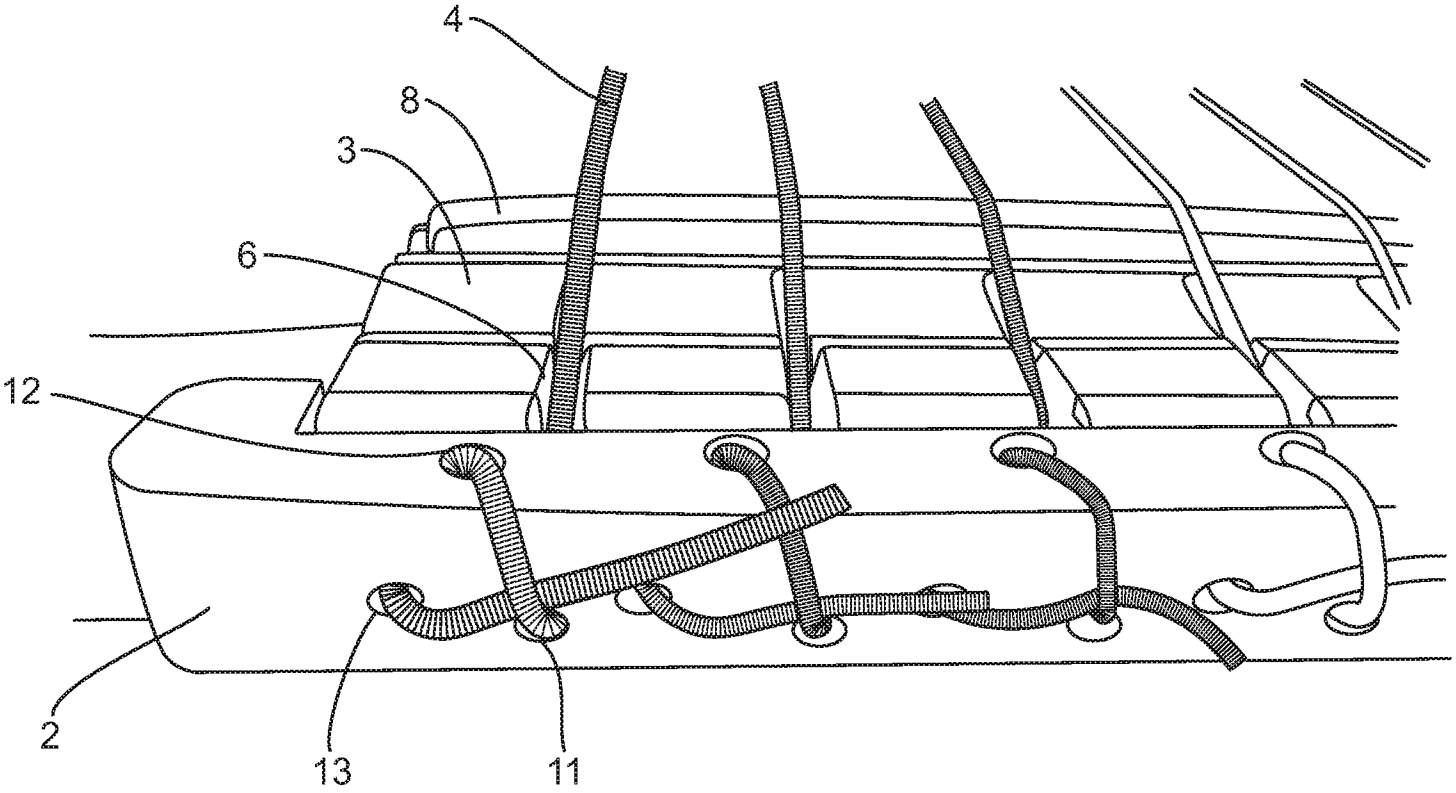
FIG. 6 is a perspective view of the detachable portion fixed to the non-detachable portion in the further embodiment of the detachable portion.

FIG. 6 shows the same arrangement of apertures that are used to secure the string to the detachable portion 2. FIG. 6 shows the strings 4 passing over the saddle 8 and into the string retaining channel 6 on the non-detachable portion 3. The strings then pass through the detachable portion as described for FIG. 5. The entrance to the first aperture 10 (not shown in FIG. 6) receives the string 4 and this string passes through the first aperture and exits at the exit to the first aperture 11. The string 4, as described above, passes through the entrance to the second aperture 12 and exits at the exit to the second aperture 13. The string 4 is then secured to the detachable portion by tucking it under the loop formed by the string 4 between the exit of the first aperture 11 and the entrance to the second aperture 12.

Figure 7:
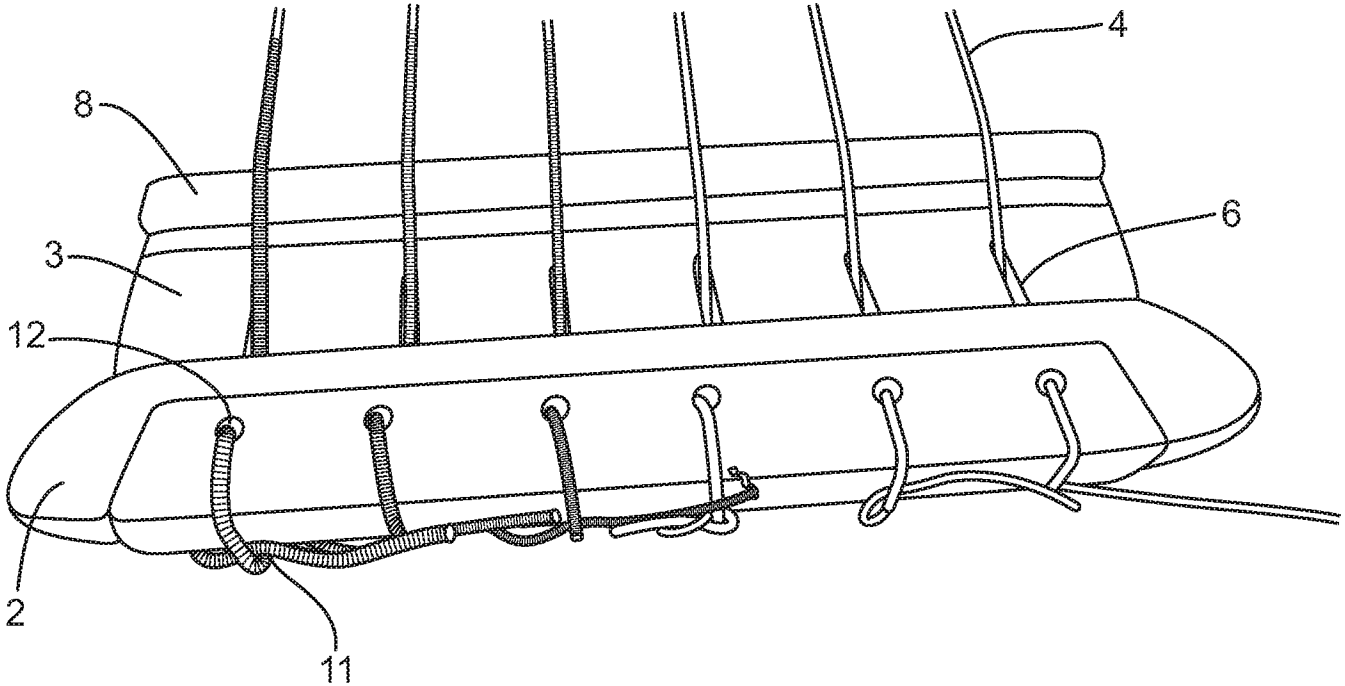
FIG. 7 is close up perspective view of the detachable portion fixed to the non-detachable portion in an alternative further embodiment of the detachable portion.

FIG. 7 shows a view of the detachable portion 2 coupled to the non-detachable portion 3 from above. This view shows the string 4 passing over the saddle 8 and into the string retaining channel 6. The string passing from the exit of the first aperture 11 to the entrance of the second aperture 12 is also shown.

This angle of the second aperture between the entrance of the second aperture 12 in the upper surface and the exit of the second aperture 13 in the proximal end is limited by two things:

(1) the need to have a wide enough surface-area of wood for the main fixed bridge to form a firm anchor with the body: if the bridge were much narrower, the angle made by the string could be greater, giving greater "crispness" of sound, but the bridge itself may be at risk of breaking away from the body of the stringed instrument.

(2) The angle of the string is also limited by the need to keep the end of the string away from the surface of the body of the stringed instrument. If it were to emerge flush with the body, the angle could be slightly steeper, but "buzzing" is likely to occur during playing due to the string end vibrating on the wood, and this must be avoided in the interests of a good clear sound.

Figure 8:
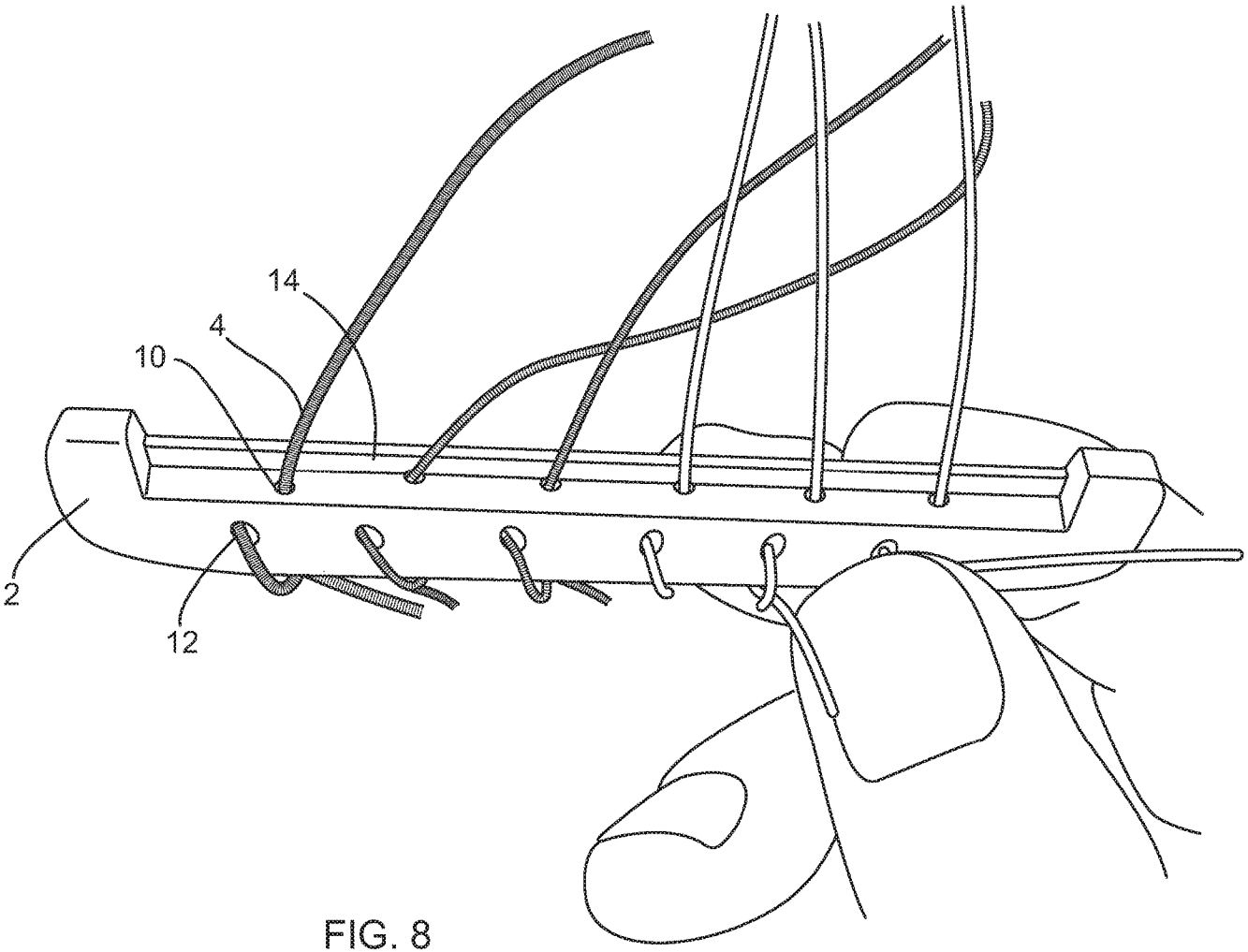
FIG. 8 is a perspective view of the alternative further embodiment of the detachable portion as detached from the non-detachable portion.

FIG. 8 shows the detachable portion 2 detached from guitar. This view shows the string passing through the entrance to the first aperture 10 and the entrance to the second aperture 12. In the embodiment of FIG. 8, the detachable portion has a tongue 14 which slots into a groove on the non-detachable portion 3 to secure the detachable portion 2 to the non-detachable portion 3. The tongue 14 forms a step in the detachable portion such that a protrusion projects from the surface of the detachable portion that abuts the non-detachable portion. When the detachable portion is coupled to the non-detachable portion, the tongue is secured within the groove, which may take the form of a tight fitting slot, and this tight fit prevents unwanted detachment of the detachable portion due to the tension of the strings producing a force that would force the detachable portion away from the body of the stringed instrument and the detachable portioned forced perpendicular to the body of the stringed instrument. Therefore, the detachable portion may be held in position and retained by the engagement of the tongue and groove of the non-detachable portion.

The tongue 14 of the detachable portion 2 may be formed by formed by removing wood only from the upper surface to form a step, the under surface of which has not been cut into. The tongue 14 formed creates a protrusion from the surface that couples to the non-detachable portion 2. The groove in the non-detachable portion 3 may be positioned a short distance above the main surface of the body of the guitar 9. In an alternative embodiment, this arrangement can be reversed with the detachable portion comprising the groove and the non-detachable portion comprising a tongue. However, it is advantageous to cut the groove into the detachable portion 2 rather than the non-detachable portion 3. The detachable portion 2 is necessarily very lightweight (only a few grams) in order to minimize the total overall weight of the bridge (less than 25 gms) and, the lighter the bridge, the more responsive the instrument. If the groove were to be cut into the detachable portion 2, there would have been insufficient wood remaining to ensure strength and the detachable portion 2 would be weakened.

In one embodiment the detachable portion 2 of the bridge is positioned such that it there is 1.5 mm clearance between the lower surface of the detachable portion 2 and the body of the guitar 9. The clearance may be made by positioning a tongue-in-groove connection between the detachable portion 2 and the non-detachable portion 3.

In one embodiment, the stringed instrument may have both a retaining means being a tongue and groove arrangement, the tongue being on either the detachable or non-detachable portions, and a means to prevent movement of the detachable portion in a direction substantially perpendicular to the direction of the body, for example a lip.

In alternative embodiments, the detachable portion 2 and non-detachable portion 3 may further comprise dovetail arrangement to further secure the two portions when joined.

The invention claimed is:

1. An apparatus for reversibly detaching the strings of a stringed instrument as a single piece from a bridge of the stringed instrument comprising: a detachable portion and a non-detachable portion, wherein the non-detachable portion is adapted to secure the detachable portion, wherein the non-detachable portion comprises a retaining lip to prevent inadvertent detachment of the detachable portion, wherein the retaining lip is adapted to retain the detachable portion against the tension of the strings when in use, wherein the retaining lip prevents movement of the detachable portion in a direction substantially perpendicular to the direction of the body, wherein the retaining lip protrudes in a plane substantially parallel to the body of the stringed instrument in a direction away from the neck of the stringed instrument and wherein the retaining lip comprises the string retaining channels through which each string can pass.

2. The apparatus according to claim 1, wherein the detachable portion further comprises at least one aperture for reversibly coupling to the strings of the stringed instrument.

3. The apparatus according to claim 1, wherein the detachable portion comprises at least one aperture for each of the strings in the detachable portion.

4. The apparatus according to claim 3, wherein the non-detachable portion comprises one string retaining channel for each of the strings which correspond to the position of the strings coupled to the detachable portion such that when the detachable portion is secured by the non-detachable portion the strings coupled to the detachable portion each sits within a corresponding string retaining channel.

5. The apparatus according to claim 1, wherein the detachable portion secured to the non-detachable portion is positioned above the surface of the body of the stringed instrument.

6. The apparatus according to claim 5, wherein the non-detachable portion secured to the non-detachable portion positions the strings of the stringed instrument over an aperture of sound box of the stringed instrument.

7. The apparatus according to claim 1, wherein the detachable portion further comprises a tongue.

8. The apparatus according to claim 7, wherein the non-detachable portion comprises a groove, wherein the tongue of the detachable portion reversibly couples to the groove in the non-detachable portion such that the tongue of the detachable portion is secured by the groove of the non-detachable portion.

9. The apparatus according to claim 8, wherein the detachable portion is secured to the non-detachable portion about 1.5 mm above the surface of the soundbox.

10. The apparatus according to claim 9, wherein the non-detachable portion comprises both a retaining element and a groove and the detachable portion comprises a tongue.

11. The apparatus according to claim 9, wherein the detachable portion comprises a groove and the non-detachable portion comprises both a retaining lip and a tongue.

12. The apparatus according to claim 11, wherein the detachable portion comprises four side walls and an upper and lower surface, wherein one of the side walls is a distal end that faces towards the neck of the stringed instrument and another side wall is a proximal end that faces away from the neck of the stringed instrument, wherein the proximal and distal side walls extend substantially perpendicular to the plane of an upper surface of the soundbox, and wherein the upper surface and lower surface are parallel to the plane of the surface of the soundbox.

13. The apparatus according to claim 12, wherein the detachable portion has two or more apertures for securing the strings to the detachable portion.

14. The apparatus according to claim 13, wherein a first aperture of the at least two apertures in the detachable portion forms a conduit between the proximal end and the distal end.

15. The apparatus according to claim 14, wherein a second aperture of the at least two apertures in the detachable portion forms a conduit between the upper surface and the proximal end.

16. The apparatus according to claim 15, wherein the first aperture and the second aperture are positioned offset from one another such that a string of the stringed instrument may be secured by passing the string through the first aperture and then the second aperture.

17. The apparatus of claim 1, wherein the stringed instrument comprises a guitar.

18. The apparatus of claim 17, wherein the guitar comprises a collapsible guitar.

19. An apparatus for reversibly detaching the strings of a stringed instrument as a single piece from a bridge of the stringed instrument comprising a detachable portion and a non-detachable portion, wherein the detachable portion has two or more apertures for securing the strings to the detachable portion, wherein a first aperture of the at least two apertures in the detachable portion forms a conduit between the proximal end and the distal end, wherein a second aperture of the at least two apertures in the detachable portion forms a conduit between the upper surface and the proximal end.

20. The apparatus according to claim 19, wherein the first aperture and the second aperture are positioned offset from one another such that a string of the stringed instrument may be secured by passing the string through the first aperture and then the second aperture.

* * * * *